US008479900B2

(12) United States Patent
Scicluna

(10) Patent No.: US 8,479,900 B2
(45) Date of Patent: Jul. 9, 2013

(54) LUGGAGE EXPANSION SYSTEM

(75) Inventor: Paul Scicluna, Penndel, PA (US)

(73) Assignee: Tumi, Inc., Plainfield, NJ (US)

( * ) Notice: Subject to any disclaimer, the term of this patent is extended or adjusted under 35 U.S.C. 154(b) by 374 days.

(21) Appl. No.: 13/005,318

(22) Filed: Jan. 12, 2011

(65) Prior Publication Data

US 2012/0175207 A1 Jul. 12, 2012

(51) Int. Cl.

| | |
|---|---|
| ***A45C 7/00*** | (2006.01) |
| ***B23P 17/04*** | (2006.01) |
| ***F16M 13/02*** | (2006.01) |

(52) U.S. Cl.

USPC ... 190/105; 190/103; 248/224.8; 248/223.41; 29/428

(58) Field of Classification Search

USPC ..... 190/103–105, 107; 248/125.3, 221.11, 248/222.11, 223.41, 224.8, 674; 290/428

See application file for complete search history.

(56) References Cited

U.S. PATENT DOCUMENTS

| | | | | |
|---|---|---|---|---|
| 440,278 | A * | 11/1890 | Payntar | 190/105 |
| 701,440 | A * | 6/1902 | Wilkinson | 190/105 |
| 764,144 | A * | 7/1904 | McGowan | 190/105 |
| 2,110,617 | A * | 3/1938 | Wolff | 190/105 |
| 5,082,094 | A * | 1/1992 | Nechushtan | 190/105 |
| 5,819,891 | A * | 10/1998 | Wang et al. | 190/103 |
| 6,220,411 | B1 * | 4/2001 | Scicluna et al. | 190/103 |
| 6,305,513 | B1 * | 10/2001 | Lu | 190/103 |
| 6,408,997 | B1 * | 6/2002 | Chen | 190/103 |
| 6,575,272 | B1 * | 6/2003 | Krulik et al. | 190/103 |
| 7,281,616 | B2 | 10/2007 | Peterson et al. | |
| 2002/0040834 | A1 * | 4/2002 | Chen | 190/103 |
| 2006/0070837 | A1 * | 4/2006 | King et al. | 190/105 |
| 2009/0166138 | A1 * | 7/2009 | Gorga | 190/103 |

* cited by examiner

*Primary Examiner* — Sue A Weaver
(74) *Attorney, Agent, or Firm* — Baker Bott L.L.P.

(57) ABSTRACT

A bracket assembly for mounting to a piece of expandable luggage has a base, first and second sliding members, and a lever. The base has slots, and a plurality of recesses are located between the slots and have a substantially flat sidewall. When the lever is in a locked position, a coupling portion is positioned at least partially within one of the recesses, and the notch engages the sidewall preventing the lever and sliding members from moving parallel with the slot. When the lever is in an unlocked position, stopping pegs prevent the lever from rotating more than 180 degrees relative to the locked position, and the lever and sliding members are free to move relative to the base and translationally parallel with the slots. The lever and sliding members are moveable to and from a plurality of expansion positions.

23 Claims, 5 Drawing Sheets

LUGGAGE EXPANSION SYSTEM

FIELD OF THE INVENTION

The disclosed subject matter relates to a system for expandable luggage, and in particular to a bracket for expandable luggage that can expand and retract as desired.

BACKGROUND

The needs of travelers for luggage space can vary considerably, depending on the duration of a trip, the nature of the trip in terms of the types of clothing and other gear required, and the climate of the destination. For example, regardless of the purpose and the climate, a traveler does not need as much luggage space for a trip of short duration as for a long one. Generally, a business traveler does not need as much luggage space as a recreational traveler, especially one who needs both casual and dress clothes.

One way for travelers to provide for both smaller and larger luggage space requirements is to have a moderately-sized suitcase for some trips and a large one for other trips. Another way is to have two moderate-sized suitcases and use only one when possible and use both when a larger capacity is needed. There have also been various proposals for expandable luggage. An expandable item of luggage offers the traveler a possible savings in cost as compared to the costs of purchasing more than one piece of luggage.

As common carriers increasingly charge for even one item of checked baggage, travelers desire luggage capable of meeting the size requirements for carrying with them on the vehicle. Moreover, the capability of expanding a piece of luggage permits a traveler to change the carrying capacity during the course of a trip. Not infrequently, a traveler will make purchases on a trip and will need more room for the return trip than for travel to a destination.

Most previously known luggage having a variable volume is of the "soft" type, such as a duffle bag with expandable sections that can be collapsed and secured to a main section. The expandable "hard" luggage that is currently available lacks rigidity when expanded due to inadequate linking of separate rigid frame components that move away from each other when the luggage is expanded. An item of expandable luggage with a substantially rigid frame that attempts to address these issues is described in U.S. Pat. No. 7,281,616 to Peterson et al., the disclosure of which is incorporated in its entirety by reference herein. Nevertheless, there remains a need for a sturdy luggage bracket that can be used to easily expand and retract all types of luggage.

SUMMARY

The purpose and advantages of the disclosed subject matter will be set forth in and are apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a system for expandable luggage, and in particular to a bracket assembly for expandable luggage. A bracket assembly for mounting to a piece of expandable luggage including a base is provided. The base includes first and second slots extending along at least a portion of opposing sides of the base and a plurality of recesses located between the slots and having a substantially flat sidewall. The bracket further includes first and second sliding members. The sliding members each include a protrusion extending from a first surface facing the base. The protrusion of the first sliding member is slidably positioned within the first slot and the protrusion of the second sliding member is slidably positioned within the second slot. The sliding members also each include a hole in an inner sidewall and a stopping peg extending from the inner sidewall. The bracket further includes a lever. The lever includes a handle and first and second pegs extending from opposing sides of the lever. The first peg is positioned inside the hole of the first sliding member, the second peg is positioned inside the hole of the second sliding member, and the arrangement permits at least partial rotational movement of the lever. The lever also includes a coupling portion having a notch. When the lever is in one of a plurality of locked positions, the coupling portion is positioned at least partially within one of the recesses and the notch engages the sidewall preventing the lever and sliding members from moving relative to the base and parallel with the slots. When the lever is in an unlocked position, the stopping pegs prevent the lever from rotating more than 180 degrees relative to the locked position and the lever and sliding members are movable relative to the base and translationally parallel with the slots.

In some embodiments, the base includes first and second rails proximate and substantially parallel to the slots. The base can include concavities proximate to first ends of the slots, and the first ends can be proximate to the protrusions of the sliding members when the lever is in a furthest expanded position. The sliding members can include a groove, the groove of the first sliding member slidably engaging the first rail and the groove of the second sliding member slidably engaging the second rail.

In some embodiments, the plurality of recesses can be spaced apart in a line substantially parallel to the rails. The number of recesses can be two, three, or any other suitable number. In some embodiments, the plurality of locked positions includes an retracted position and at least one expanded position. The bracket can include indicia for indicating that the lever is in the retracted position or at least one expanded position.

In some embodiments, the sliding members can be substantially identical, and can be L-shaped. Furthermore, the sliding members can include an outer sidewall having a first portion extending from the first surface to form an L-shape. The first portion can be located proximate to a sidewall of the base. The sliding members can include a second protrusion, wherein when the lever is in the retracted position, the second protrusions of the sliding members abut the concavities.

In some embodiments, the pegs couple the lever with the sliding members for translational movement relative to the base and parallel with the slots. The pegs can be of a length greater than a maximum distance the sliding members are capable of being spaced from the handle due to flexible movement of the sliding members. The lever can have a strength greater than the base.

In some embodiments, the base includes a raised platform having an opening and an indentation, wherein when the lever is in the retracted position, the sliding members abut the platform. In some embodiments, when the lever is in the retracted position, the handle rests at least partially within the indentation.

In some embodiments, a pull is coupled to the base. The pull can be made of webbing.

The disclosed subject matter also includes a luggage expansion system. The luggage expansion system includes a piece of luggage having a first frame component and a second frame component defining a volume. The luggage expansion system also includes a bracket assembly. The bracket assembly can include any of the features described herein above. The sliding members are fastened to the first frame component of the luggage and the base is fastened to the second frame component of the luggage. The movement of the sliding members relative to the base causes a corresponding movement of the second frame component relative to the first frame component and changes the volume of the piece of luggage.

In some embodiments, the piece of luggage can include a gusset, and the piece of luggage can be zipperless about the gusset.

The disclosed subject matter also includes a method of assembling a bracket assembly for expandable luggage. The method includes forming a base comprising first and second slots extending along at least a portion of opposing sides of the base and a plurality of recesses located between the slots and having a substantially flat sidewall. The method also includes forming first and second sliding members comprising a protrusion extending from a first surface, a hole in an inner sidewall, and a stopping peg extending from the inner sidewall. The method also includes forming a lever comprising a handle, first and second pegs extending from opposing sides of the lever, and a coupling portion having a notch. The method includes slidably mounting the protrusion of the first sliding member within the first slot and the protrusion of the second sliding member within the second slot. The method includes positioning the first peg inside the hole of the first sliding member and the second peg inside the hole of the second sliding member to permit at least partial rotational movement of the lever. The bracket assembly can include any of the features described herein above.

The disclosed subject matter also includes a method of expanding a piece of expandable luggage. The method includes rotating the lever into an unlocked position. In the unlocked position, the stopping pegs prevent the lever from rotating more than 180 degrees relative to a first position. The method also includes sliding the lever and sliding members relative to the base and translationally parallel with the slots and locking the lever in a second position. In the second position, the coupling portion is positioned at least partially within a second recess of the plurality of recesses and the notch engages the sidewall of the second recess preventing the lever and sliding members from moving relative to the base and parallel with the slots.

In some embodiments, the first position can be a retracted position, and the second position can be an expanded position. In some embodiments, the method can include locking the lever in a further position. In the further position, the coupling portion is positioned at least partially within a further recess of the plurality of recesses, and the notch engages the sidewall of the further recess preventing the lever and sliding members from moving relative to the base and parallel with the slots.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION

Reference will now be made in detail to the exemplary embodiments of the disclosed subject matter, an example of which is illustrated in the accompanying drawings. The method and corresponding steps of the disclosed subject matter will be described in conjunction with the detailed description of the system.

As disclosed herein, the devices and methods presented can be used for expanding a piece of expandable luggage. In particular, the disclosed subject matter is particularly suited for making and using a bracket for a piece of expandable luggage.

Figure 1:
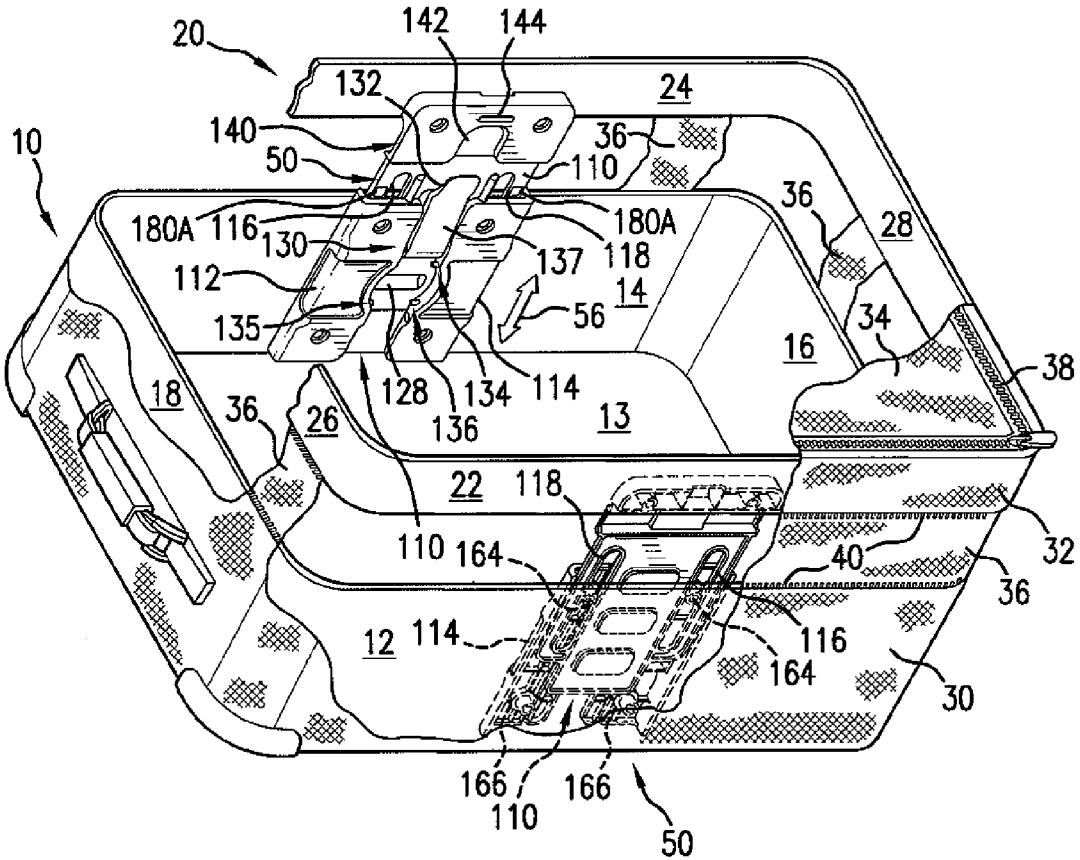
FIG. 1 is a schematic three-quarter front pictorial view of an exemplary embodiment according to the disclosed subject matter, with portions broken away.

For the purpose of explanation and illustration, and not limitation, an exemplary embodiment is shown in FIG. 1. Particularly and as illustrated, the embodiment shown in FIG. 1 has a two-component frame, which can be of any suitable specific construction in terms of materials, manner of assembly, and configurations of the parts. The luggage, as shown in FIG. 1, includes a main frame component 10, which can have a pair of rectangular planar sidewall panels 12 and 14, a bottom wall member 16 and a top wall member 18, which can be substantially rigid and rigidly connected at the corners. Although FIG. 1 shows the bottom and top members as panels, most travel luggage being marketed currently is of the towable, wheeled type. In practice for such luggage items, the bottom and top members, as well as other portions of the main frame can be configured to accept wheels, a towing handle, a carrying handle, and the like. The main frame component 10 can also have a partial or complete rigid back wall panel 13. A secondary frame component 20 can be formed of opposite rectangular planar panels 22 and 24 and top and bottom members 26 and 28, which as a practical matter should usually also be rectangular planar panels of sheet material.

The main frame component 10 can receive a cover 30 of a durable fabric. The sides, top, and bottom of the secondary frame can receive a fabric cover 32. Access to the interior of the luggage item can be through a front opening that is closed by a panel 34, can be joined to the cover 32 at the bottom edge and can be opened and closed by use of a zipper 38 along three sides.

The main part (main frame 10 and its cover 30) of the luggage item can be joined to the secondary part (secondary frame 20 and its cover 32, 34) by a gusset 36 of a durable, flexible material that extends along the entire perimeter of the luggage item (along the top, bottom and both sidewalls). In the expanded state of the item, the gusset 36 peripherally can bound that part of the entire volume of the main compartment by which the volume of the item can be increased upon movement of the secondary unit away from the main unit. In the collapsed (smaller volume) position (not shown) of the luggage item, a zipper 40 that extends about the entire perimeter of the item can be used to aid in keeping the luggage in the collapsed position. Alternatively, the luggage can made without a zipper 40 about the gusset, with the luggage maintained in the collapsed position by bracket assemblies 50. The gusset 36 can fold into the interior of the luggage.

The main frame component 10 can be joined to the secondary frame component 20 by two bracket assemblies 50, preferably substantially identical to each other and one of which can be associated with the side panels 12 and 22 and the other with the side panels 14 and 24.

As shown in FIGS. 2A-2D, each bracket assembly 50 consists of a base 110 that can be attached with fasteners to an inside surface of the rectangular planar panels 22, 24 of the secondary frame component 20, and two sliding members 112, 114 that can be slidably received within the base 110 and can be attached with fasteners to inside surfaces of the rectangular planar side panels 12, 14 of the main frame component 10. Alternatively, this configuration can be transposed, with base 110 being attached to the main frame component 10 and the sliding members 112, 114 being attached to the secondary frame component 20. The sliding members 112, 114 can be slidable relative to the base 110 between the collapsed position of the luggage item and the expandable positions of the luggage item, as shown in FIGS. 2A-2D. (For convenience of reference, the axis of sliding movement of the sliding members is referred to herein as the vertical axis, i.e., in the axis defined by the arrow 56 of FIG. 1). The base 110 and sliding member 112, 114 can be made of polypropylene, or any other suitable material, to provide strength while allowing limited flexible movement of the luggage frame components 10, 20, the base 110, and the sliding members 112, 114.

Figure 3:
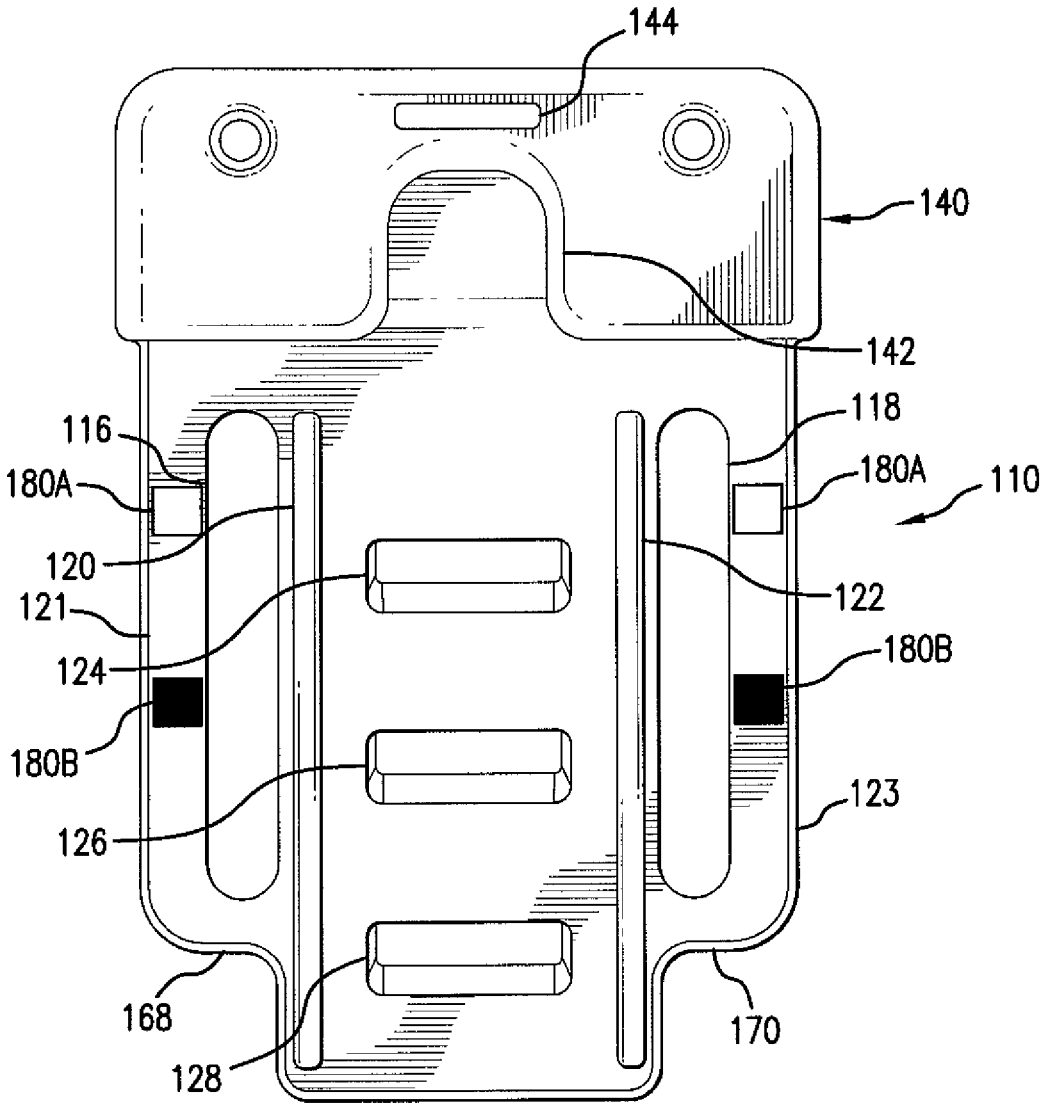
FIG. 3 is a front view of the base of the expansion bracket.

As shown in FIG. 3, for the purpose of illustration and not limitation, the base 110 includes a pair of slots 116, 118 extending along at least a portion of opposing sides of the base. The slots 116, 118 can be oval or any other suitable configuration.

Figure 4A:
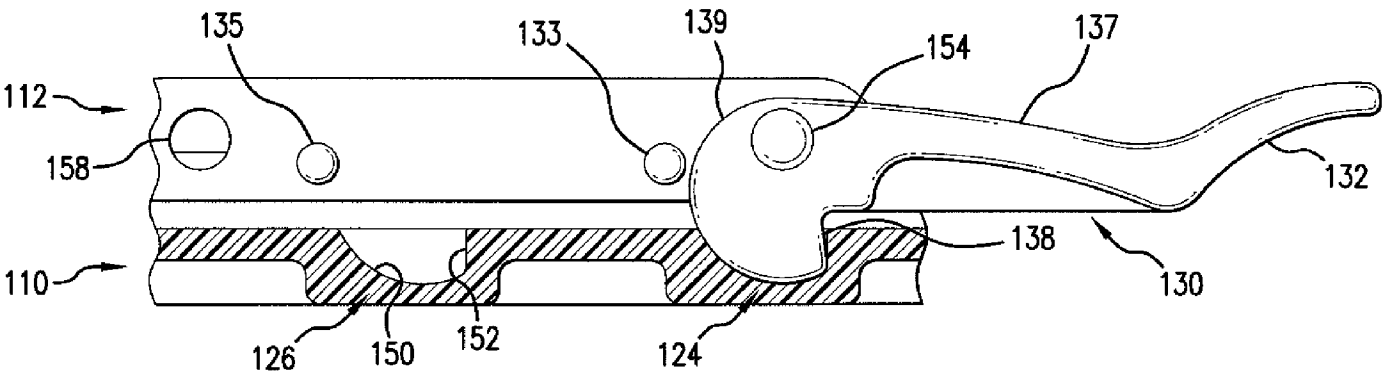
FIG. 4A is a side view of the expansion bracket with the lever in a locked position, with portions broken away.
Figure 4B:
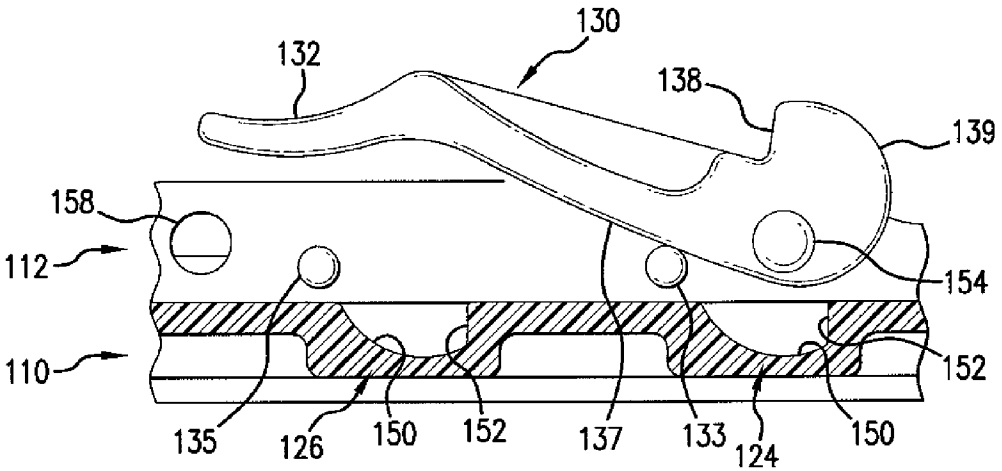
FIG. 4B is a side view of the expansion bracket with the lever in an unlocked position, with portions broken away.
Figure 7:
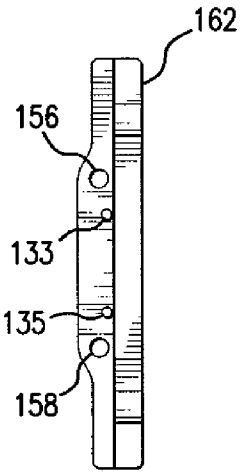
FIG. 7 is a side view of a sliding member of the expansion bracket.
Figure 6:
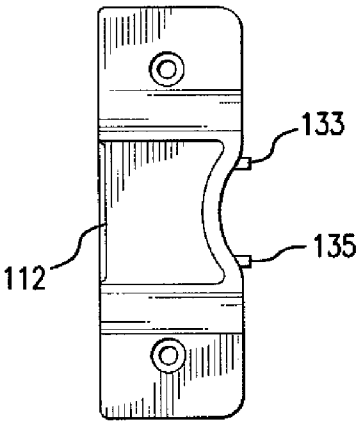
FIG. 6 is a front view of a sliding member of the expansion bracket.
Figure 5:
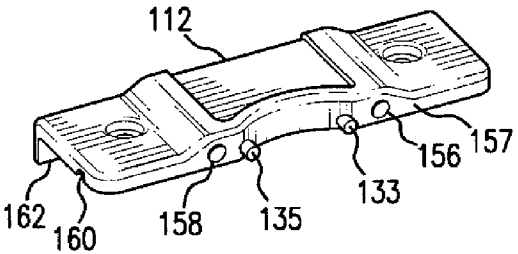
FIG. 5 is a perspective view of a sliding member of the expansion bracket.

The base 110 includes a plurality of recesses 124, 126, 128 located between the slots 116, 118 and, as shown in FIG. 4B for the purpose of illustration and not limitation, having a bottom 150 and a substantially flat sidewall 152. The recesses 124, 126, 128 can be spaced apart in a line parallel to the slots 116, 118.

Figure 2A:
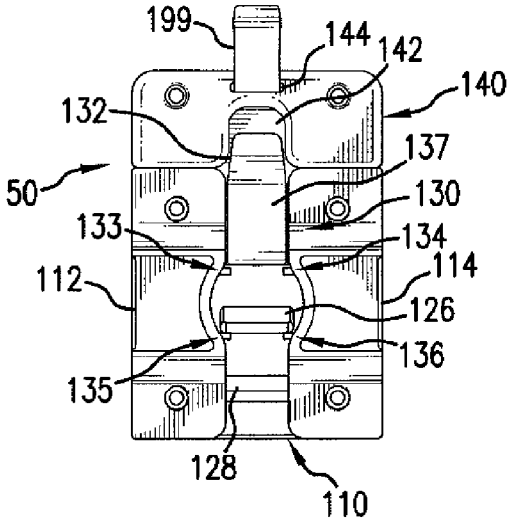
FIG. 2A is a front view of the expansion bracket, locked in a retracted position.
Figure 2B:
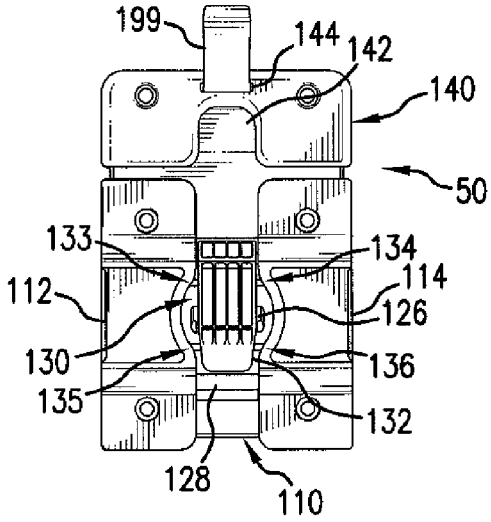
FIG. 2B is a front view of the expansion bracket in an unlocked position.
Figure 2C:
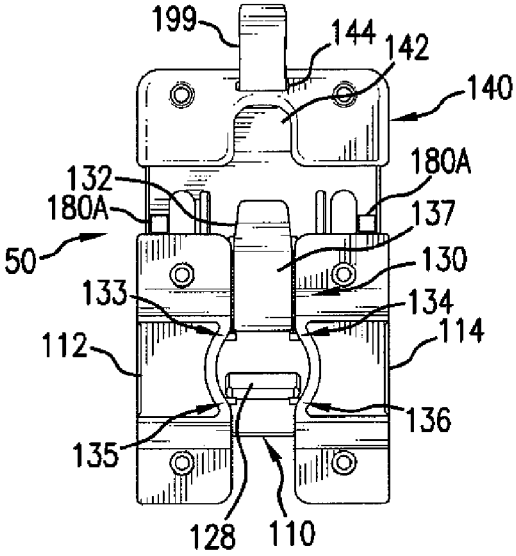
FIG. 2C is a front view of the expansion bracket, locked in an expanded position.
Figure 2D:
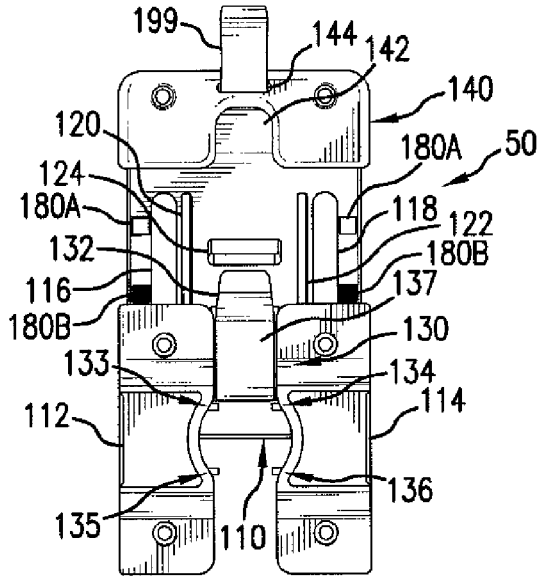
FIG. 2D is a front view of the expansion bracket, locked in a further expanded position.

As shown in FIG. 3, a pair of ridges 120, 122, can be formed on the base 110 proximate and substantially parallel to the slots 116, 118. A pair of concavities 168, 170 can be formed on the base 110 proximate an end of the slots 116, 118, as will be discussed in further detail below. The base 110 can include a raised platform 140 having an opening 144 and an indentation 142. As shown in FIG. 2B-2D for the purpose of illustration and not limitation, pull 199 can be attached within the opening 144. Pull 199 can be made of a webbing or fabric and can be a loop. The pull 199 can provide a grippable extension for the user to grip and pull the luggage bracket 50 to move the base 110 relative to the sliding members 112, 114

As shown in FIGS. 2C, 2D, and 3 for the purpose of illustration and not limitation, the base 110 can have indicia 180A, 180B to indicate that the bracket is in one or more positions. A portion of the sliding members 112, 114 can be positioned adjacent to a corresponding color or symbol, or other suitable indicia 180A, 180B, when the bracket is in a corresponding position. For example and without limitation, an indicium 180A can be a yellow sticker, or other suitable indicator, corresponding to a first expanded position, and an indicium 180B can be a red sticker, or other suitable indicator, corresponding to a further expanded position. Further indicia can be included to indicate a retracted position or any number of expanded positions.

The sliding members 112, 114 can be substantially identical, which allows for fewer molds to be used to form the components of bracket assembly 50. As shown in FIGS. 5-9, for the purpose of illustration and not limitation, a sliding member 112 has a protrusion 164 extending from a first surface facing the base 110. The protrusion 164 of each sliding member 112, 114 is slidably positioned within a corresponding slot 116, 118 of the base 110, as shown in FIG. 3. Sliding member 112 has a hole 156 in an inner sidewall 157 and a stopping peg 133 extending from the inner sidewall 157. Sliding member 112 can have another stopping peg 135 extending from the inner sidewall 157. The other stopping peg 135 can allow for sliding member 112 to be substantially identical to sliding member 114, and thus allow for interchangeability of parts, and can provide additional functionality, as described below.

Figure 9:
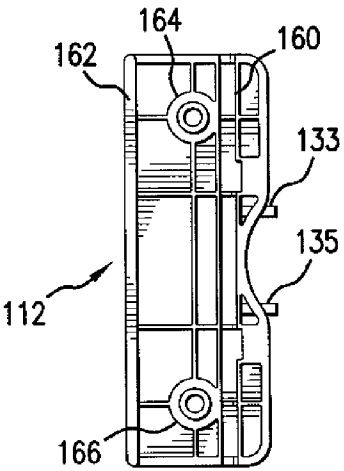
FIG. 9 is a back view of a sliding member of the expansion bracket.
Figure 8:
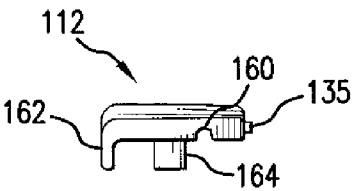
FIG. 8 is a top view of a sliding member of the expansion bracket.

As shown in FIG. 8, sliding member 112 can be L-shaped, with an outer sidewall 162 extending from a surface of the sliding member 112 to form the L-shape. The sidewall 162 of each sliding member 112, 114 can be located proximate to a corresponding sidewall 121, 123 of the base, as shown in FIG. 3, to provide support and restrict lateral movement of the sliding members 112, 114 relative to the base 110. Sliding member 112 can also have a groove 160. The groove 160 of each sliding member 112, 114 can slidably engage a corresponding rail 120, 122 of the base 110, as shown in FIG. 3, to provide support and facilitate sliding relative to the base 110 along the vertical axis 56, while restricting lateral movement of the sliding members 112, 114. Sliding member 112 can also have a second protrusion 166, as shown in FIG. 9, for example. The second protrusion 166 can allow for sliding member 112 to be substantially identical to sliding member 114, and thus allow for interchangeability of parts, and can provide additional functionality, as described below.

Figure 10:
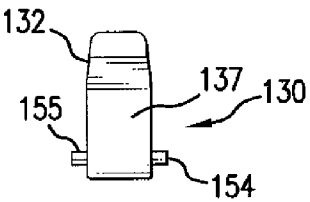
FIG. 10 is a front view of the lever of the expansion bracket.

As illustrated in FIGS. 4A-4B, without limitation, the lever 130 has a handle 132 and pegs 154, 155 (as shown in FIG. 10 for the purpose of illustration and not limitation) extending from the lever 130 in opposite directions. Each peg 154, 155 is positioned inside a corresponding hole 156, 158 in the sliding members 112, 114 and is arranged to permit at least partial rotational movement of the lever 130. The pegs 154, 155 can be round, or any other suitable shape, for positioning inside the corresponding holes 156, 158. Pegs 154, 155 can couple the lever 130 with sliding members 112, 114 in translational movement relative to the base 110 and parallel with the slots 116, 118. Pegs 154, 155 can be of a length greater than a maximum distance the sliding members 112, 114 are capable of being spaced from the handle 132 due to flexible movement of the sliding members 112, 114 and the base 110. The lever 130 also has a coupling portion 139 with a notch 138. The lever 130 can have a strength greater than that of the base 110. For example, the lever 130 can be made of nylon plastic, or any other suitable material, to provide greater strength and reduced flexibility to prevent decoupling of the lever 130 from the sliding members 112, 114 due to flexing of the pegs 154, 155.

FIG. 4A shows lever 130 in a locked position. When lever 130 is in a locked position, the coupling portion 139 is positioned at least partially within one of the recesses 124, 126, 128 and the notch 138 engages a sidewall of the recess, such as sidewall 152, preventing the lever 130 and sliding members 112, 114 from moving relative to the base 110 and parallel with the slots 116, 118.

FIG. 4B shows lever 130 in an unlocked position. When lever 130 is in an unlocked position, each stopping peg 133, 134 of the sliding members 112, 114 prevents the lever 130 from rotating more than 180 degrees relative to the locked position, and the lever 130 and sliding members 112, 114 are free to move translationally relative to the base 110 and parallel with the slots 116, 118.

In accordance with another aspect of the disclosed subject matter, a method of assembling a bracket 50 is provided. The method includes forming a base 110 comprising first and second slots 116, 118 extending along at least a portion of opposing sides of the base 110 and a plurality of recesses 124, 126, 128 located between the slots 116, 118 and having a substantially flat sidewall 152. The method also includes forming first and second sliding members 112, 114 comprising protrusions 164, 166 extending from a first surface, holes 156, 158 in an inner sidewall 157, and a stopping peg 133, 134 extending from the inner sidewall 157. The method also includes forming a lever 130 comprising a handle 132, first and second pegs 154, 155 extending from opposing sides of the lever 130, and a coupling portion 139 having a notch 138. The method includes slidably mounting the protrusion 164 of the first sliding member 112 within the first slot 116 and the protrusion 164 of the second sliding member 114 within the second slot 118. The method includes positioning the first peg 154 inside the hole 156 of the first sliding member 112 and the second peg 155 inside the hole 156 of the second sliding member 114 to permit rotational movement of the lever 130. The bracket 50 can include any of the features described herein above.

In accordance with another aspect of the disclosed subject matter, a method of expanding a bracket 50 is provided. A piece of expandable luggage 10 includes a base 110 having first and second slots 116, 118 extending along at least a portion of opposing sides 121, 123 of the base 110 and a plurality of recesses 124, 126, 128 located between the slots 116, 118 and having a bottom 150 and a substantially flat sidewall 152. The expandable luggage 10 also includes sliding members 112, 114, each having a protrusion 164 extending from a surface, holes 156, 158 in an inner sidewall 157, and a stopping peg 133 extending from the inner sidewall 157. The expandable luggage 10 also includes a lever 130 having a handle 132, pegs 154, 155 extending from the lever 130 in opposite directions, and a coupling portion 139 having a notch 138.

In practice, a corresponding protrusion 164 of each sliding member 112, 114 is slidably mounted within the slots 116, 118. Each peg 154, 155 is positioned inside a corresponding hole 156, 158 in the inner sidewall 157 of the sliding members 112, 114.

The lever 130 is locked in a first position, which may be a retracted position. In the retracted position, the coupling portion 139 is positioned at least partially within a first recess 124 of the plurality of recesses 124, 126, 128 and the notch 138 engages the sidewall 152 of the first recess 124 preventing the lever 130 and sliding members 112, 114 from moving relative to the base 110 and parallel with the slots 116, 118.

The method of expanding the piece of expandable luggage 10 includes rotating the lever 130 into an unlocked position. Lifting the lever 130 for rotation can cause the sliding members 112, 114 to flex relative to the base 110 sufficiently to provide space for the notch 138 of the coupling portion 139 to clear the sidewall 152 of the recesses 124, 126, 128. The coupling portion 139 can be rounded to facilitate rotation of the lever 130, and the bottom 150 of the recesses 124, 126, 128 can be arcuate to receive the coupling portion 139 and facilitate rotation of the coupling portion 139 within the recess 124, 126, 128. In the unlocked position, the stopping pegs 133, 134 prevent the lever 130 from rotating more than 180 degrees relative to the first locked position. Next, the method includes sliding the lever 130 and sliding members 112, 114 translationally relative to the base 110 and parallel with the slots 116, 118. Next, the lever 130 is locked in a second position, which can be an expanded position. In an expanded position, the coupling portion 139 is positioned at least partially within a second recess 126 of the plurality of recesses 124, 126, 128 and the notch 138 engages the sidewall 152 of the second recess 126 preventing the lever 130 and sliding members 112, 114 from moving relative to the base 110 and parallel with the slots 116, 118.

The user can move the lever 130 into an unlocked position (as shown in FIGS. 2B and 4B for the purpose of illustration and not limitation) by gripping the handle 132 and rotating the lever 130 back towards stopping pegs 133, 134. Stopping pegs 133, 134 can abut the lever 130 when the lever is rotated into an unlocked position and can prevent the lever 130 from rotating 180° from the locked position, maintaining the handle 132 of the lever 130 in a position above the base 110 and allowing for easier gripping of the handle 132 by the user. In alternate embodiments, the height and the position of the stopping pegs 133, 134 relative to the axis of rotation of the lever 130 can be altered to adjust the minimum height above the base 110 that the lever 130 can be maintained. In an exemplary embodiment, the bottom of the handle 132 of the lever 130 when abutting a respective stopping peg 133, 134 can extend a height of about 12 mm above the bottom of the sliding members 112, 114. Additionally, the other stopping pegs 135, 136 can similarly prevent the lever 130 from rotating 180° from the locked position, maintaining the handle 132 of the lever 130 in a position above the base 110 and allowing for easier gripping of the handle 132 by the user, in the event of breakage of stopping pegs 133, 134.

In the unlocked position, lever 130 and sliding members 112, 114 can slide relative to the base 110 on the vertical axis 56 towards recess 126 to an expanded position (as shown in FIG. 2C for the purpose of illustration and not limitation). Upon reaching the expanded position, with the coupling portion 139 of the lever 130 adjacent to the recess 126, the user can lock the bracket by rotating the lever 130 forward, away from the stopping pegs 133, 134 positioning the coupling portion 139 into engagement with recess 126 with the coupling portion 139 resting against the bottom 150 of recess 126 and the notch 138 engaging the sidewall of recess 126.

The bracket can be expanded into a further expanded position (as shown in FIG. 2D for the purpose of illustration and not limitation), corresponding to recess 128, by performing the same process of unlocking the lever 130, sliding the coupled lever 130 and sliding members 112, 114 relative to the base 110 on the vertical axis 56 towards recess 128, and locking the lever 130 by rotating the coupling portion 139 into engagement with recess 128. The bracket can be similarly retracted by unlocking the lever 130, sliding the coupled lever 130 and sliding members 112, 114 relative to the base 110 on the vertical axis 56 towards the raised platform 140, and locking the lever 130 by rotating the coupling portion 139 into engagement with the desired recess. These steps of expansion and retraction of the bracket can be performed with a greater or fewer number of recesses than those shown in the figures, depending on the desired size and configuration of the luggage, with the number of expansion positions being dependent on the number of recesses accessible by the lever 130 and the preferred number recesses being two or three.

As shown in phantom in FIG. 1, the linear movement of the coupled lever 130 and sliding members 112, 114 relative to the base 110 on the vertical axis 56 can be limited by the range of movement of protrusion 164 of the sliding members 112, 114 within the oval apertures 116, 118 of the base 110. The linear movement of the coupled lever 130 and sliding members 112, 114 relative to the base 110 on the vertical axis 56 can be further limited by the raised platform 140, which can abut the sliding members 112, 114 in the retracted position. The linear movement of the coupled lever 130 and sliding members 112, 114 relative to the base 110 on the vertical axis 56 can be further limited by a second protrusion 166 of each sliding member 112, 114, where the second protrusion 166 of each sliding member 112, 114 can abut the corresponding concavity 168, 170 of the base 110 when the bracket is in the retracted position.

While the disclosed subject matter is described herein in terms of certain exemplary embodiments, those skilled in the art will recognize that various modifications and improvements can be made to the disclosed subject matter without departing from the scope thereof. As such, the particular features claimed below and disclosed above can be combined with each other in other manners within the scope of the disclosed subject matter such that the disclosed subject matter should be recognized as also specifically directed to other embodiments having any other possible permutations and combinations. It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

The invention claimed is:

1. A bracket assembly for mounting to a piece of expandable luggage comprising:

a base comprising first and second slots extending along at least a portion of opposing sides of the base and a plurality of recesses located between the slots and having a substantially flat sidewall;

first and second sliding members each comprising:

a protrusion extending from a first surface facing the base, the protrusion of the first sliding member slidably positioned within the first slot and the protrusion of the second sliding member slidably positioned within the second slot;

a hole in an inner sidewall; and a stopping peg extending from the inner sidewall;

a lever comprising:

a handle;

first and second pegs extending from the lever in opposite directions, the first peg positioned inside the hole of the first sliding member and the second peg positioned inside the hole of the second sliding member and arranged to permit at least partial rotational movement of the lever;

a coupling portion having a notch;

wherein, when the lever is in one of a plurality of locked positions, the coupling portion is positioned at least partially within one of the recesses and the notch engages the sidewall preventing the lever and sliding members from moving relative to the base and parallel with the slots; and wherein, when the lever is in an unlocked position, the stopping pegs prevent the lever from rotating more than 180 degrees relative to the locked position and the lever and sliding members are movable relative to the base and translationally parallel with the slots.

2. The bracket assembly of claim 1, the base further including first and second rails proximate and substantially parallel to the slots.

3. The bracket assembly of claim 2, each sliding member further including a groove, the groove of the first sliding member slidably engaging the first rail and the groove of the second sliding member slidably engaging the second rail.

4. The bracket assembly of claim 1, wherein the plurality of recesses are spaced apart in a line parallel to the slots.

5. The bracket assembly of claim 1, wherein the number of recesses is two.

6. The bracket assembly of claim 1, wherein the number of recesses is three.

7. The bracket assembly of claim 1, wherein the sliding members are substantially identical.

8. The bracket assembly of claim 1, wherein the sliding members are L-shaped.

9. The bracket assembly of claim 1, wherein a pull is coupled to the base.

10. The bracket assembly of claim 9, wherein the pull is made of webbing.

11. The bracket assembly of claim 1, each sliding member further including an outer sidewall having a first portion extending from the first surface to form an L-shape, the first portion located proximate to a sidewall of the base.

12. The bracket assembly of claim 1, wherein the pegs couple the lever with the sliding members for translational movement relative to the base and parallel with the slots.

13. The bracket assembly of claim 1, wherein the pegs are of a length greater than a maximum distance the sliding members are capable of being spaced from the handle due to flexible movement of the sliding members.

14. The bracket assembly of claim 1, wherein the lever has a strength greater than the base.

15. The bracket assembly of claim 1, the plurality of locked positions including a retracted position and at least one expanded position.

16. The bracket assembly of claim 15, the bracket assembly further including at least one indicium for indicating that the lever is in the at least one expanded position.

17. The bracket assembly of claim 15, the base further including concavities proximate to first ends of the slots, the first ends being proximate to the first sliding member protrusions when the lever is in a furthest expanded position.

18. The bracket assembly of claim 17, the sliding members each further including a second protrusion, wherein when the lever is in the retracted position, the second protrusion of each sliding member abuts a corresponding concavity of the base.

19. The bracket assembly of claim 15, the base further including a raised platform, wherein when the lever is in the retracted position, the sliding members abut the platform.

20. The bracket assembly of claim 19, the raised platform further including an indentation, wherein when the lever is in the retracted position, the handle rests at least partially within the indentation.

21. A luggage expansion system comprising:

a piece of luggage comprising a first frame component and a second frame component defining a volume; and a bracket assembly comprising:

a base comprising first and second slots extending along at least a portion of opposing sides of the base and a plurality of recesses located between the slots and having a substantially flat sidewall;

first and second sliding members comprising:

a protrusion extending from a first surface facing the base, the first sliding member protrusion slidably positioned within the first slot and the second sliding member protrusion slidably positioned within the second slot;

a hole in an inner sidewall; and a stopping peg extending from the inner sidewall;

a lever comprising:

a handle;

first and second pegs extending from the lever in opposite directions, the first peg positioned inside the hole of the first sliding member and the second peg positioned inside the hole of the second sliding member and arranged to permit at least partial rotational movement of the lever;

a coupling portion having a notch;

wherein, when the lever is in one of a plurality of locked positions, the coupling portion is positioned at least partially within one of the recesses and the notch engages the sidewall preventing the lever and sliding members from moving relative to the base and parallel with the slots; and wherein, when the lever is in an unlocked position, the stopping pegs prevent the lever from rotating more than 180 degrees relative to the locked position and the lever and sliding members are movable relative to the base and translationally parallel with the slots;

wherein the sliding members are fastened to the first frame component of the luggage and the base is fastened to the second frame component of the luggage, the movement of the sliding members relative to the base causing a corresponding movement of the second frame component relative to the first frame component and changing the volume of the piece of luggage.

22. The luggage expansion system of claim 21, wherein the piece of luggage further includes a gusset, the piece of luggage being zipperless about the gusset.

23. A method of assembling a bracket for mounting to a piece of expandable luggage, comprising the steps of:

forming a base comprising first and second slots extending along at least a portion of opposing sides of the base and a plurality of recesses located between the slots and having a substantially flat sidewall; first and second sliding members comprising a protrusion extending from a first surface, a hole in an inner sidewall, and a stopping peg extending from the inner sidewall; and a lever comprising a handle, first and second pegs extending from the lever in opposite directions, and a coupling portion having a notch;

slidably mounting the protrusion of the first sliding member within the first slot and the protrusion of the second sliding member within the second slot;

positioning the first peg inside the hole of the first sliding member and the second peg inside the hole of the second sliding member to permit at least partial rotational movement of the lever.

* * * * *